US008033631B2

(12) United States Patent
Kanno

(10) Patent No.: US 8,033,631 B2
(45) Date of Patent: Oct. 11, 2011

(54) RECORDING HEAD AND TEST APPARATUS FOR RECORDING HEAD

(75) Inventor: Hideo Kanno, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/825,085

(22) Filed: Jun. 28, 2010

(65) Prior Publication Data

US 2010/0315454 A1 Dec. 16, 2010

Related U.S. Application Data

(63) Continuation of application No. PCT/JP2009/060910, filed on Jun. 16, 2009.

(51) Int. Cl.
*B41J 2/01* (2006.01)

(52) U.S. Cl. ..... 347/17

(58) Field of Classification Search ..... 347/9, 10, 347/17–19

See application file for complete search history.

(56) References Cited

U.S. PATENT DOCUMENTS

| | | | | |
|---|---|---|---|---|
| 6,634,731 | B2 | 10/2003 | Kao | |
| 6,755,580 | B2 * | 6/2004 | Furukawa et al. | 400/120.01 |
| 7,722,148 | B2 * | 5/2010 | Takabayashi et al. | 347/17 |
| 2007/0229566 | A1 | 10/2007 | Takabayashi | |
| 2007/0291066 | A1 | 12/2007 | Takabayashi | |

FOREIGN PATENT DOCUMENTS

| | | | |
|---|---|---|---|
| JP | 2007-290361 | A | 11/2007 |
| JP | 2007-331353 | A | 12/2007 |

* cited by examiner

*Primary Examiner* — An Do
(74) *Attorney, Agent, or Firm* — Canon USA, Inc. IP Division

(57) ABSTRACT

A recording head in which a plurality of recording elements is arranged in an order is provided. The recording head includes a plurality of driving circuits that generate signals for driving transistors, each of the plurality of driving circuits being provided for a corresponding one of the plurality of recording elements. The recording head further includes a plurality of temperature acquisition circuits that acquire temperatures of the recording elements and a signal generation circuit that generates signals for sequentially driving the recording elements. The temperature acquisition circuit corresponding to the first recording element performs acquisition of a temperature based on a signal that is generated by the driving circuit corresponding to the second recording element and a signal that is generated by the driving circuit corresponding to the third recording element.

7 Claims, 10 Drawing Sheets

RECORDING HEAD AND TEST APPARATUS FOR RECORDING HEAD

CROSS REFERENCE TO RELATED APPLICATIONS

This application is a Continuation of PCT Application No. PCT/JP2009/060910 filed on Jun. 16, 2009, which is hereby incorporated by reference herein in its entirety.

TECHNICAL FIELD

The present invention relates to a recording head and a test apparatus for the recording head.

BACKGROUND ART

A recording head that discharges ink using heat which recording elements (heaters) generate includes temperature detection elements (temperature sensors) for detecting temperatures. Information concerning temperatures is acquired using the temperature detection elements, and control of the heaters is performed. In Cited Document 1, a configuration is described, in which driving circuits that drive heaters and a temperature detection circuit that acquires temperature information from temperature sensors are provided, and in which control is performed using signals supplied from a control section that is provided in the body of a recording apparatus. In Cited Document 2, a configuration is described, in which driving circuits for heaters and temperature detection circuits are controlled using common signals.

CITATION LIST

Patent Literature

Patent Document 1: Japanese Patent Laid-Open No. 2007-290361

Patent Document 2: U.S. Pat. No. 6,634,731

SUMMARY OF INVENTION

Technical Problem

However, in order to test a state of the recording head, temperature information concerning temperatures in a predetermined time period after the heaters are driven is acquired from the sensors. When control for this is performed using the technology described in Cited Document 1, control of control signals that are to be output to the recording head becomes complicated. Furthermore, in the technology described in Cited Document 2, the common signals are used for timings at which the heaters are driven and timings at which information is acquired from temperature sensors. Thus, even though the timings can be made to be different from one another, this is accompanied by significant restrictions.

Solution to Problem

A recording head according to the present invention is a recording head in which first, second, and third recording elements are arranged in an order. The recording head includes a plurality of driving circuits that generate signals for driving transistors, each of the plurality of driving circuits being provided for a corresponding one of the first, second, and third recording elements; a plurality of temperature acquisition circuits that acquire temperatures of the recording elements, each of the plurality of temperature acquisition circuits being provided for a corresponding one of the first, second, and third recording elements; and a signal generating circuit that generates signals for sequentially driving the first, second, and third recording elements. The temperature acquisition circuit corresponding to the first recording element performs acquisition of a temperature on the basis of a signal that is generated by the driving circuit corresponding to the second recording element and a signal that is generated by the driving circuit corresponding to the third recording element.

Advantageous Effects of Invention

Using the above-described configuration, a circuit that performs driving of the recording elements and acquisition of temperature information with the temperature detection elements at desired timings is realized with a simple configuration.

DESCRIPTION OF EMBODIMENTS

Figure 3:
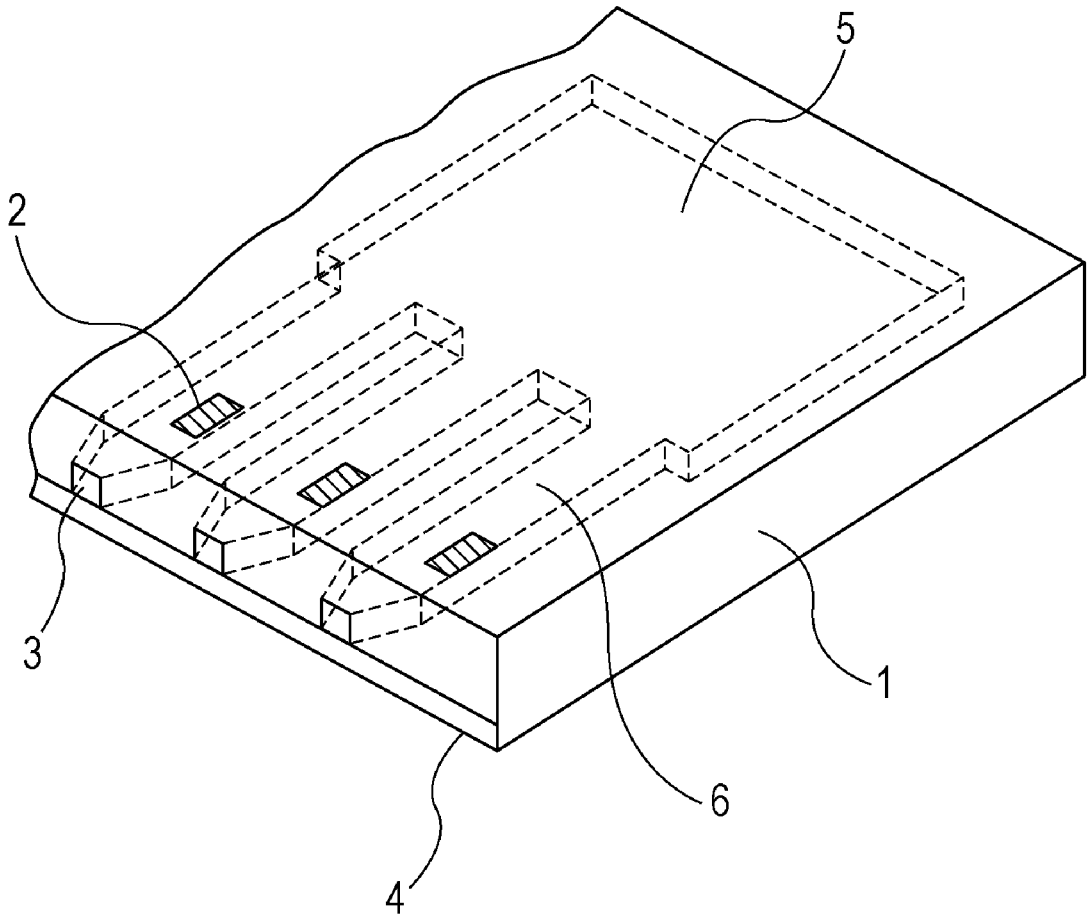
FIG. 3 is a perspective view of a recording head.

First, a recoding head will be described. FIG. 3 is a perspective view of a recording head 1. The recording head 1 discharges, from discharge ports 3, ink that resides along liquid paths 6, by utilizing thermal energy of recording elements 2. The ink is supplied from a common liquid chamber 5 to the liquid paths 6. The recording elements 2 are provided on a board 4.

Figure 6:
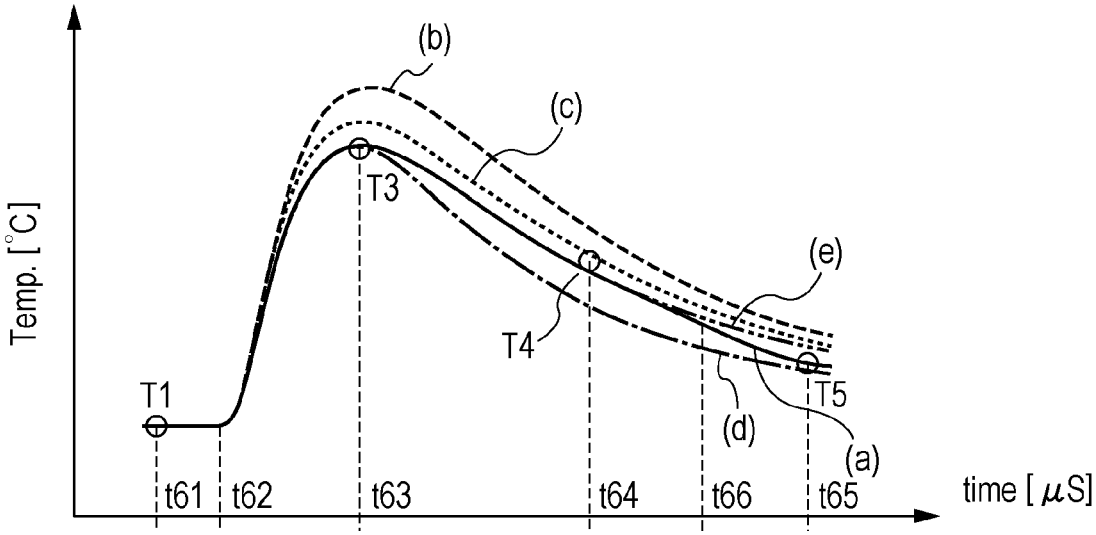
FIG. 6 is a diagram for explaining the relationships between temperatures measured by temperature detection elements and discharged states.

Next, the relationships, which are utilized to test the recording head, between temperatures of the recording head and discharged states of ink will be described. FIG. 6 illustrates temperature profiles that were detected by temperature detection elements (temperature sensors) before/after timings at which the recording elements (heaters) were driven. The vertical axis indicates temperature, and the horizontal axis indicates time. For example, a timing t62 is a timing at which driving of the heaters was started, and a timing t63 is a timing at which the driving of the heaters was terminated.

A line (a) indicates a temperature profile in a case in which ink was correctly discharged. A dotted line (b) indicates a temperature profile in a case in which a discharge failure occurred because bubbles remained in a nozzle. A dotted line (c) indicates a temperature profile in a case in which a discharge failure occurred because impurities were accumulated along flow paths of ink and refilling of ink was not correctly performed. A dotted line (d) indicates a temperature profile in a case in which a discharge failure occurred because of ink adhered to the surface of the nozzle. A dotted line (e) indicates a temperature profile in a case in which a discharge failure occurred because the discharge ports were clogged with foreign substances. As described above, the discharged states of ink and the temperature profiles correspond to each other.

When the temperature profiles are described, in a case in which discharge is correctly performed, a point (hereinafter, refereed to as an inflection point) at which a speed at which the temperature decreases sharply changes after a fixed time has elapsed since a time at which the temperature reached the highest temperature exists.

In FIG. 6, an inflection point appears at a t66 that is positioned about 4.2 μs after the t63 at which the temperature reached a highest temperature T3. A timing at which the inflection point occurs exists between a timing t64 and a timing t65. The timing at which the inflection point appears is determined in accordance with structures or characteristics of the recording head, such as the discharge ports, the flow paths of ink, the heat-generating capability of the heaters.

In contrast, in a case in which a discharge failure occurs, an inflection point may not appear, or a timing at which an inflection point appears may be different from the timing at which the inflection point appears in a correctly discharged state. Accordingly, if temperature information concerning temperatures in a time period from the timing t64 to the timing t65 is acquired with respect to the timing at which the temperature reached the highest temperature or the timing at which driving of the heaters was started, a discharged state of ink can be determined.

As a method for determining a discharged state of ink, in addition to the above-described method, a method exists, in which an initialization temperature T1 that is detected before an increase in the temperature of ink starts (for example, at a timing t61), a temperature T4 that is detected before the inflection point appears, or a temperature T5 that is detected after the inflection point appears is used. For this reason, for example, temperature information concerning temperatures in a time period from the timing t61 to the timing t64 is acquired.

Figure 8:
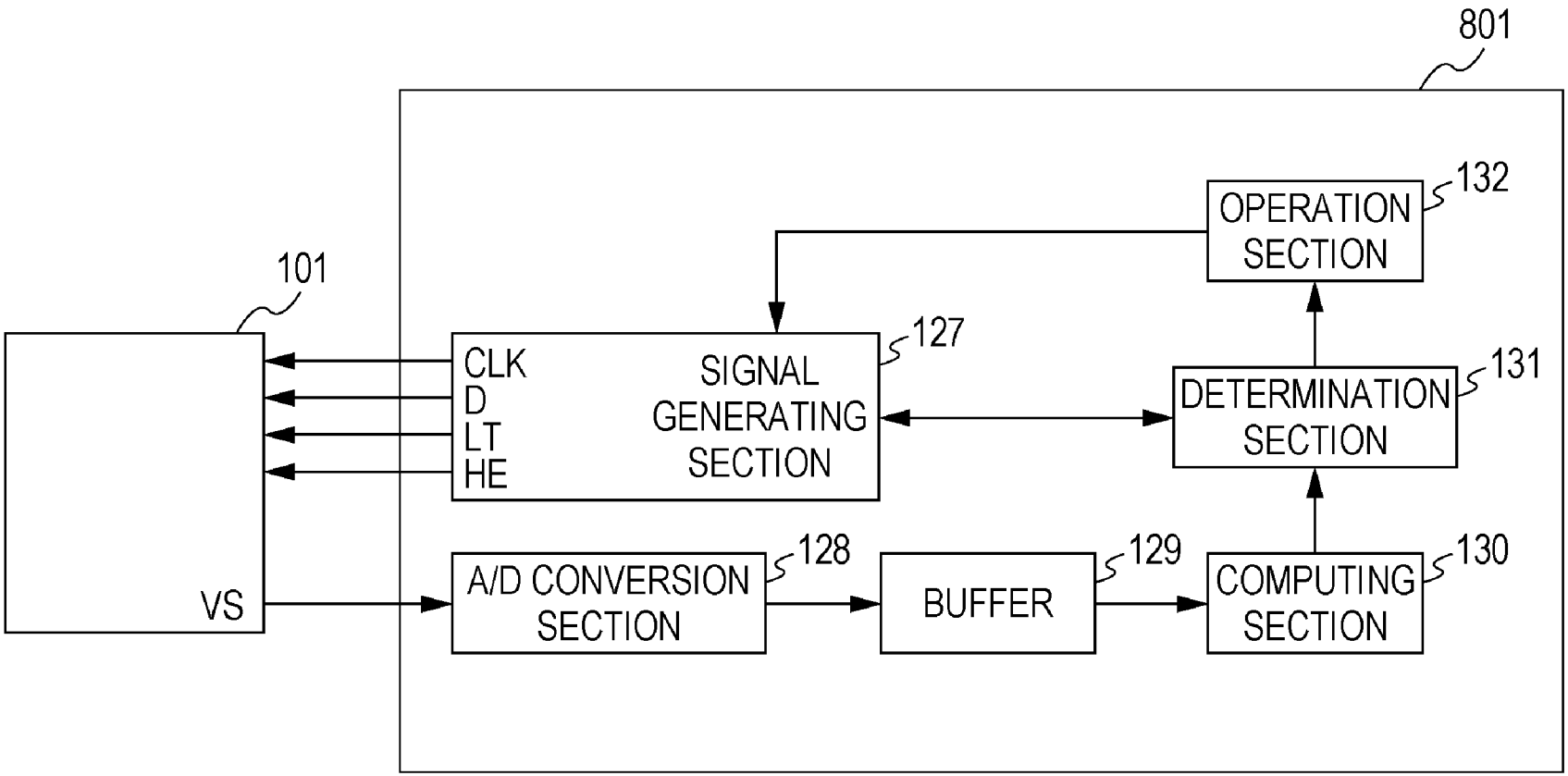
FIG. 8 is a block diagram of the test apparatus in the embodiment.

FIG. 8 is a diagram for explaining a control configuration of a test apparatus 801. A signal generating section 127 receives an instruction that is provided from an operation section 132, and outputs a clock signal (CLK), a data signal (D), a latch signal (LT), and a heat enable signal (HE) to a recording-element board 101. Meanwhile, an analog signal VS is input from the recording-element board 101 to an A/D converter 128, and the A/D converter 128 converts the analog signal VS into a digital signal. The A/D converter 128 outputs the digital signal to a buffer 129. A computing section 130 performs computation using second-order differentiation on a signal that is read from the buffer memory 129. A determination section 131 determines a result of computation performed by the computing section 130. The signal generating section 127 displays, on a display unit that is provided in the operation section 132, a determination result that the determination section 131 holds.

Note that, for simplicity of description of the configuration of the test apparatus 701, signals that are supplied from the signal generating section 127 to the other blocks, such as the A/D converter 128, the computing section 130, and the determination section 131, are omitted. The signal generating section 127 outputs signals that are synchronized with the heat enable signal (HE), the latch signal (LT), or the like to control operations of the A/D converter 128, the computing section 130, and the determination section 131.

Figure 9:
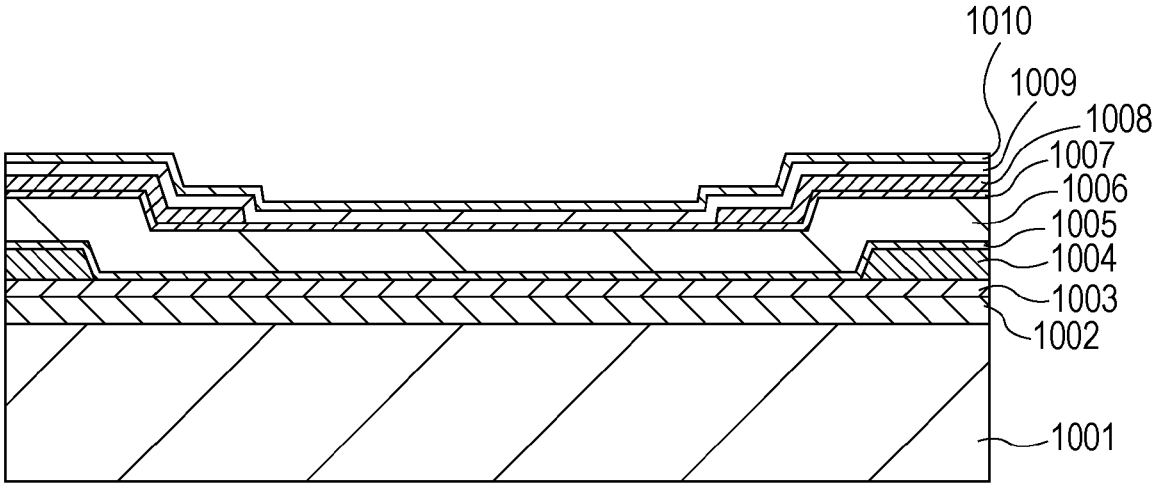
FIG. 9 is a diagram for explaining a cross section of the recording-element board.

Next, the recording-element board 101 will be described using FIG. 9. The recording-element board 101 is configured using a silicon substrate 1001, a field oxide film 1002 such as SiO2, a dielectric film 1003, temperature detection elements 1005 that are formed of thin-film resistors, wiring patterns 1004 that connect the temperature detection elements 1005 to each other, an interlayer dielectric film 1006 such as SiO, recording elements 1007 such as TaSiN, wiring patterns 1008 that connect the recording elements 1007 to driving circuits which are formed on the silicon substrate 101, a passivation film 1009 such as SiO2, and a cavitation-resistant film 1010, such as Ta, that enhances a cavitation-resistant property on the recording elements. The recording-element board 101 is formed using a semiconductor process. The plurality of temperature detection elements 1005 and the plurality of the recording elements 1007 are included in the recording-element board 101.

First Embodiment

Figure 1A:
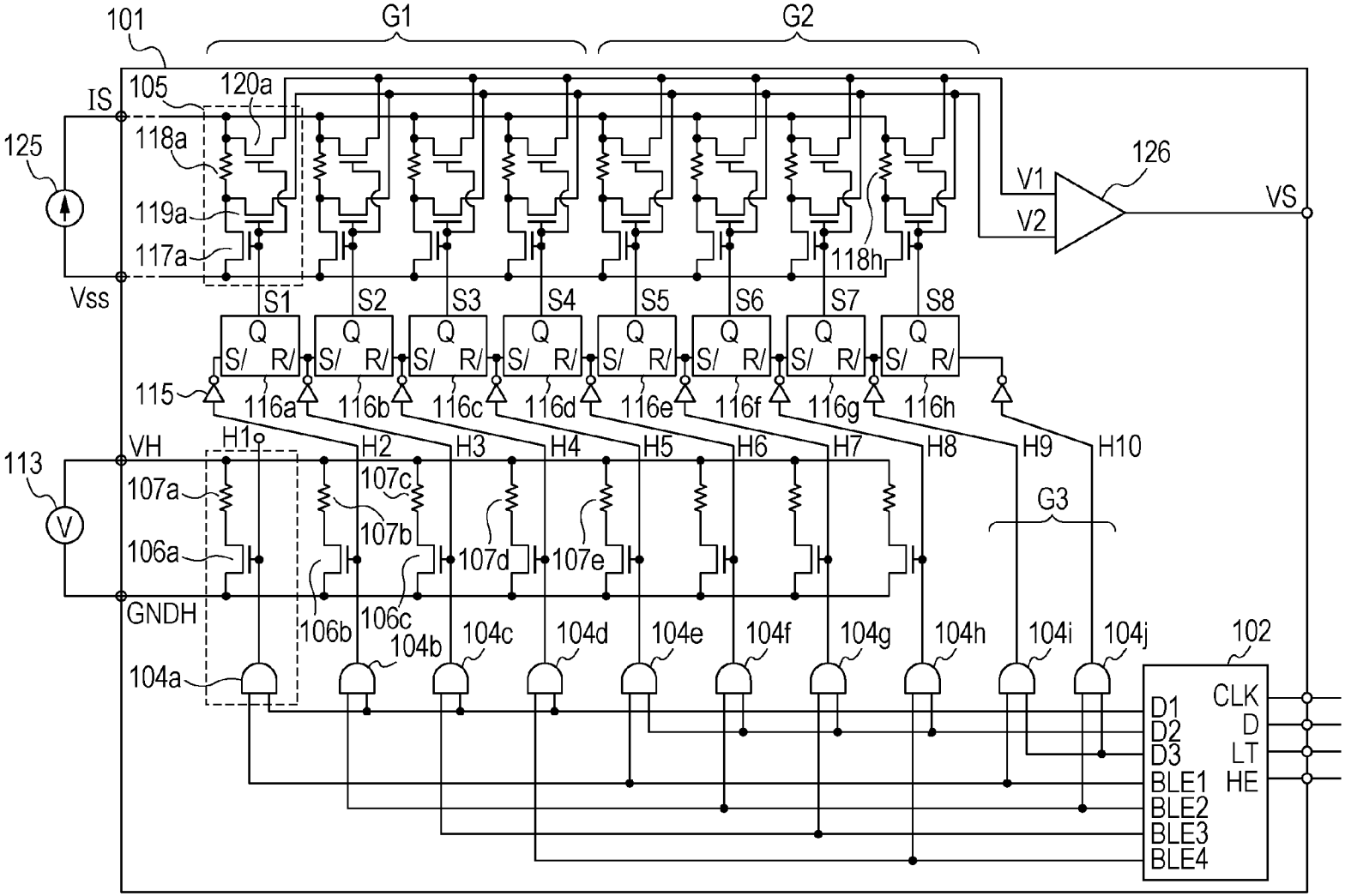
FIG. 1A is a block diagram of a recording-element board in a first embodiment.

A first embodiment will be described. FIG. 1A is a diagram for explaining a configuration of the recording-element board 101 in the first embodiment. The recording-element board 101 corresponds to the board 4 illustrated in FIG. 3. The circuit configuration is a circuit configuration for acquiring the temperature information, which is described with reference to FIG. 6, concerning temperatures in the time period from the timing t64 to the timing t65.

Here, for simplicity of description, the recording-element board 101 includes recording elements (heaters) and temperature detection elements (temperature sensors) so that each of the number of recording elements and the number of temperature detection elements is eight. The recording elements and the temperature detection elements are arranged in an order illustrated in FIG. 1.

The recording-element board 101 includes a voltage source 113 for the recording elements, a constant-current source 125 for the temperature detection elements, and input units (pads or terminals) into which signals or information is input from the outside.

A switching element (a MOS transistor) 106*a* controls application of a voltage of the voltage source 113 to a recording element (a heater) 107*a*. Switching elements 117*a*, 119*a*, and 120*a* control application of a current of the constant-current source 125 to a temperature detection element (a temperature sensor) 118*a*. The temperature detection element (the temperature sensor) 118*a* measures the temperature of the recording element (the heater) 107*a*.

Accordingly, each of measurement of temperatures, a computation process, and a determination process that are described below is performed eight times.

As described above, the clock signal (CLK), the data signal (D), the latch signal (LT), and the heat enable signal (HE) that are transformed from the test apparatus 801 are input to a signal generating circuit 102.

Figure 1B:
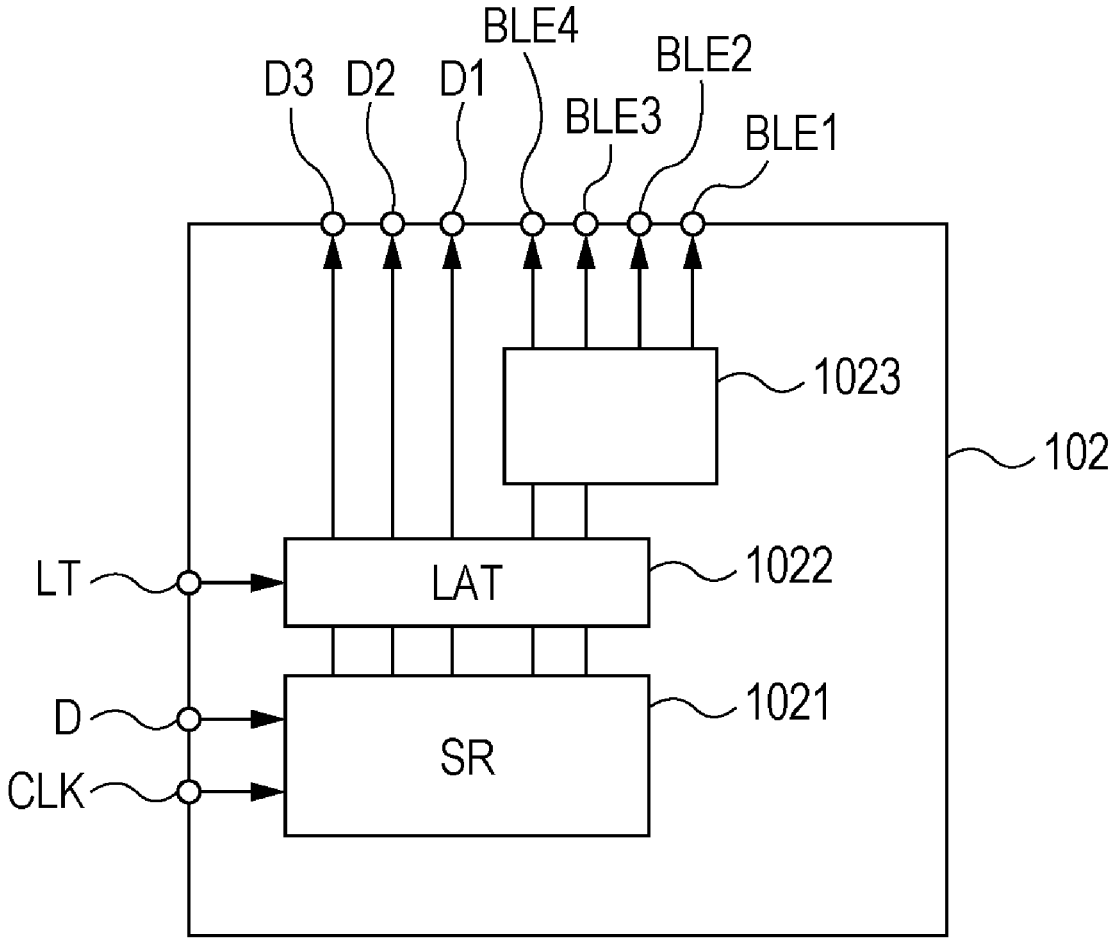
FIG. 1B is a block diagram of a signal generating section 102.

As illustrated in FIG. 1B, the signal generating circuit 102 includes a shift register 1021 to which the data signal (D) is input, and a latch circuit 1022 that latches the data which is input to the shift register. The latch circuit 1022 latches data in synchronization with the latch signal (LT), and outputs the latched data to terminals D1 to D3. Furthermore, the signal generating circuit 102 includes a decode circuit 1023 that decodes the data which is latched by the latch circuit. The decode circuit 1023 outputs a result of decoding the data to terminals BLE1 to BLE4.

The signals BLE1 to BLE4 and the signals D1 to D3 are connected between gate circuits 104*a* to 104*j* and the signal generating circuit 102 so that the signals BLE1 to BLE4 and the signals D1 to D3 are common to the gate circuits 104*a* to 104*j* and the signal generating circuit 102. Each of the gate circuits 104*a* to 104*j* outputs a pulse signal to a corresponding one of signal lines H1 to H10. Each of the gate circuits 104*a* to 104*h* is connected to a corresponding one of switching elements. The switching elements are turned on/off by the pulse signals that are output to the signal lines H1 to H8. Furthermore, the gate circuits 104*b* to 104*j* are connected to signal generating circuits (flip-flops) 116*a* to 116*h* via signal-level converters 115.

Each of the signal generating circuits (flip-flops) 116*a* to 116*h* outputs a corresponding one of signals S1 to S8. The signal generating circuits include terminals S/ for enabling the output signals and terminals R/ for disabling the signals, and switch between enabling/disabling of the signals S1 to S8 on the basis of signals that are input to the terminals.

For example, when the signal S1 is enabled, the switching elements (the MOS transistors) 117*a*, 119*a*, and 120*a* operate to output the voltage (temperature information) of the temperature detection element (the temperature sensor) 118*a* to a differential amplifier 126. In contrast, when the signal S1 is disabled, the switching elements (the MOS transistors) 117*a*, 119*a*, and 120*a* do not operate, so that the switching elements 117*a*, 119*a*, and 120*a* do not perform outputting of the voltage (temperature information) of the temperature detection element (the temperature sensor) 118*a* to the differential amplifier 126. This is also similarly applied to the other signals S2 to S8.

One driving circuit 103 is configured using the switching element 106*a*, the recording element 107*a*, and the gate circuit 104*a*. Furthermore, one temperature acquisition circuit 105 is configured using the switching elements 117*a*, 119*a*, and 120*a* and the temperature detection element 118*a*. Accordingly, in the circuit configuration illustrated in FIG. 1, eight driving circuits and eight temperature acquisition circuits are included.

Additionally, the eight driving circuits and the eight temperature acquisition circuits are divided into two groups G1 and G2. Each of the groups is configured using four driving circuits and four temperature acquisition circuits. Further, the gate circuits 104*i* and 104*j* are assigned to a group G3.

Figure 2:
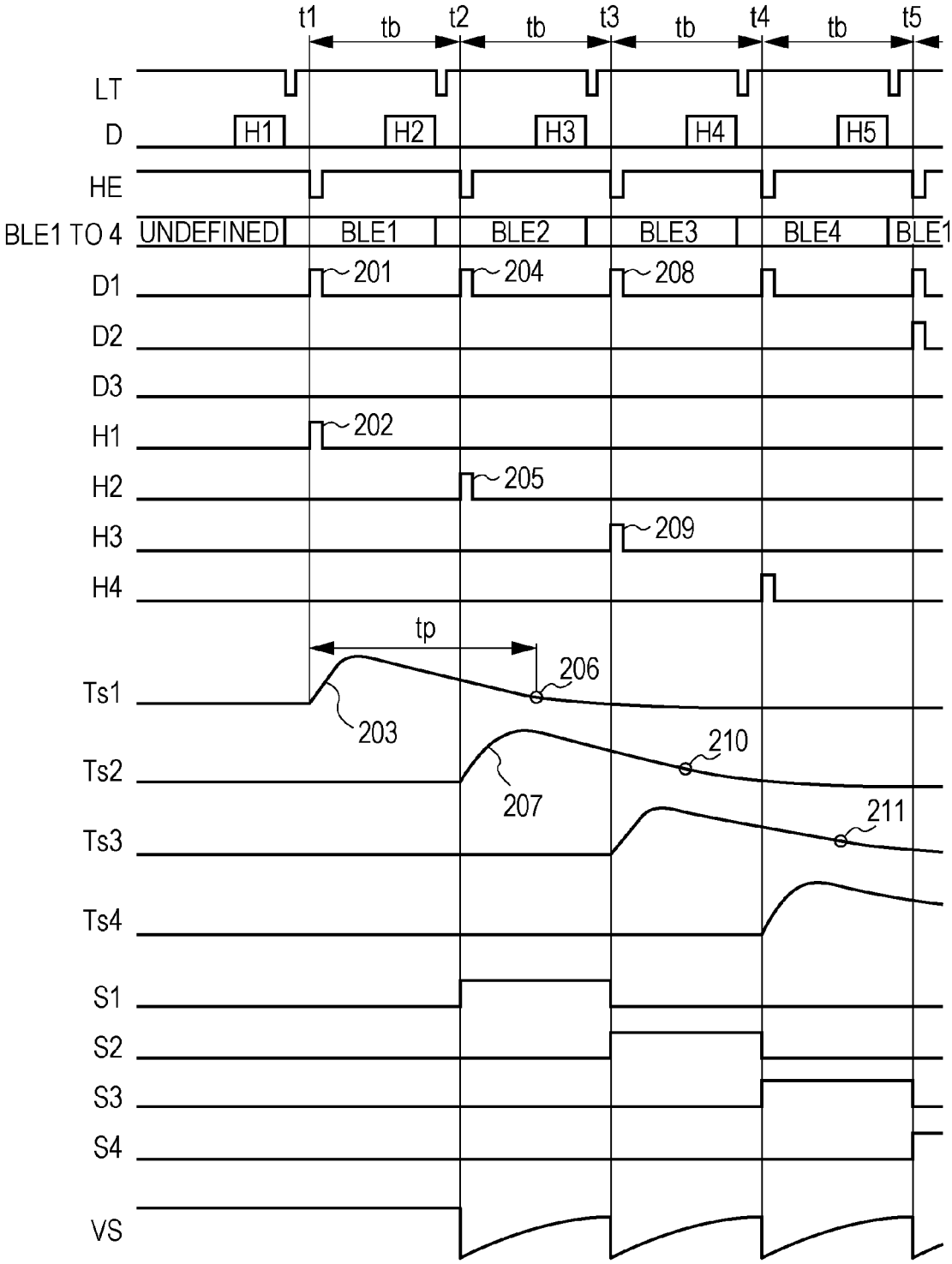
FIG. 2 is a diagram for explaining timings at which control of the recording-element board is performed in the first embodiment.

FIG. 2 is a diagram for explaining an operation of the recording-element board 101 that is described with reference to FIG. 1. The clock signal (CLK), the data signal (D), the latch signal (LT), and the heat enable signal (HE) that are transformed from a recording apparatus are input to the signal generating circuit 102 that is provided in the recording-element board 101. The latch signal (LT) and the heat enable signal (HE) are input to the signal generating circuit 102 in such a manner that the latch signal (LT) and the heat enable signal (HE) have a period tb.

First, when a data signal D including an instruction (H1) for driving the recording element 107*a* is input to the signal generating circuit 102, the signal generating circuit 102 enables a signal that is to be output from the terminal BLE1. Then, the signal generating circuit 102 outputs a pulse 201 from the data terminal D1 at a timing t1. The signals are input to the gate circuit 104*a*, and the gate circuit 104*a* outputs a pulse 202 to the signal line H1. Hence, the switching element 106*a* enters an on-state, and the recording element 107*a* is driven. Heat is generated by the driving, and a temperature Ts1 that is detected by the temperature sensor 118*a* has a profile such as a profile denoted by 203.

Next, when a data signal D including an instruction (H2) for driving the recording element 107*b* is input to the signal generating circuit 102, the signal generating circuit 102 enables a signal that is to be output from the terminal BLE2. Then, the signal generating circuit 102 outputs a pulse 204 from the data terminal D1 at a timing t2. The signals are input to the gate circuit 104*b*, and the gate circuit 104*b* outputs a pulse 205 to the signal line H2. Hence, the switching element 106*b* enters an on-state, and the recording element 107*b* is driven. Heat is generated by the driving, and a temperature Ts2 that is detected by the temperature detection element 118*b* temporarily increases as indicated by a profile denoted by 207.

Meanwhile, the pulse 205 is input to the terminal S/ of the signal generating circuit (the flip-flop) 116*a*. Hence, the signal generating circuit (the flip-flop) 116*a* enables the signal S1 (sets the signal S1 to be in a high-level state). Hence, outputting of voltages V1 and V2, which correspond to the temperature Ts1, to the differential amplifier 126 is started at the timing t2.

Next, when a data signal D including an instruction (H3) for driving the recording element 107*c* is input to the signal generating circuit 102, the signal generating circuit 102 enables a signal that is to be output from the terminal BLE3. Then, the signal generating circuit 102 outputs a pulse 208 from the terminal D1 at a timing t3. The signals are input to the gate circuit 104*c*, and the gate circuit 104*c* outputs a pulse 209 to the signal line H3. Hence, the switching element 106*c* enters an on-state, and the recording element 107*c* is driven.

Meanwhile, the pulse 209 is input to the terminal R/ of the signal generating circuit (the flip-flop) 116*a*. Hence, the signal generating circuit (the flip-flop) 116*a* disables the signal S1 (sets the signal S1 to be in a low-level state). Hence, outputting of the voltages V1 and V2, which correspond to the temperature Ts1, to the differential amplifier 126 is terminated at the timing t3. Hence, the recording element 107*a* can acquire temperature information (temperature information concerning the temperature of the recording element 107*a*) concerning temperatures in a time period from the timing t2 to the timing t3 after driving of the recording element 107*a* has started. In the temperature information, a temperature 206 that is detected after a time tp has elapsed since the driving started is included. A timing corresponding to the temperature 206 corresponds to the t66 illustrated in FIG. 6.

Meanwhile, the pulse 209 is input to the terminal S/ of the signal generating circuit (the flip-flop) 116*b*. Hence, the signal generating circuit (the flip-flop) 116*b* enables the signal S2 (sets the signal S2 to be in a high-level state). Hence, outputting of voltages V1 and V2, which correspond to the temperature Ts2, to the differential amplifier 126 is started at the timing t3.

Thereafter, similarly, pulses are sequentially output from the gate circuits 104*d* to 104*j*, and driving of the recording elements and outputting of temperature information that is detected by the temperature sensors are performed.

Hence, temperature information concerning temperatures, which include a temperature 210, in an interval tb (temperature information concerning the temperature of the recording element 107*b*) and temperature information concerning temperatures, which include a temperature 211, in an interval tb (temperature information concerning the temperature of the recording element 107*c*) can be sequentially acquired.

A pulse for disabling the signal S2 is output to the signal generating (flip-flop) circuit 116*h* on the basis of a signal H10 that is output from the gate circuit 104*j*, so that a sequence which is performed in the recording-element board 101 finishes.

Next, the signals that are output from the signal generating circuit 102 will be described. The signals that are output from the terminals BLE1 to BLE4 are used to select the recording elements that are to be simultaneously driven. In FIG. 1, a signal line for the terminal BLE1 is connected to the gate circuits 104*a*, 104*e*, and 104*i*. Accordingly, when the signal line for the terminal BLE1 is enabled, the recording elements 107*a* and 107*e* can be simultaneously driven. Similarly, a signal line for the terminal BLE2 is connected to the gate circuits 104*b*, 104*f*, and 104*j*. Accordingly, when the signal line for the terminal BLE2 is enabled, the recording elements 107*b* and 107*f* can be simultaneously driven. Similarly, when a signal line for the terminal BLE3 is enabled, the recording elements 107*c* and 107*g* can be simultaneously driven. When a signal line for the terminal BLE4 is enabled, the recording elements 107*d* and 107*h* can be simultaneously driven. In other words, when switching among signals that are to be output from the terminal BLE1 to 4 is performed using time division, the recording elements 107*a* to 107*h* can be driven using time division.

Accordingly, a case will be described, in which the recording head is mounted in the recording apparatus, and in which image data that is received from a host apparatus is recorded on a recording medium.

The recording apparatus converts image data into record data with a data processing section, and transfers the record data to the recording head. The signal generating circuit 102 that is provided in the recording head enables the terminals BLE1 to 4 using time division, and outputs data from the terminals D1 and D2, thereby driving the recording elements 107*a* to *h*.

In order to record data corresponding to one column (eight dots), a sequence in which the recording elements 107*a* to *h* are driven is divided into four timings, and time division driving in which one recording element that belongs to each of the groups G1 and G2 is driven at each of the timings is used. In other words, recording of data corresponding to one dot with each of the recording elements is performed four times in units of two dots. In the driving, one signal among the terminals BLE1 to 4 is enabled for one drive timing.

Figure 7:
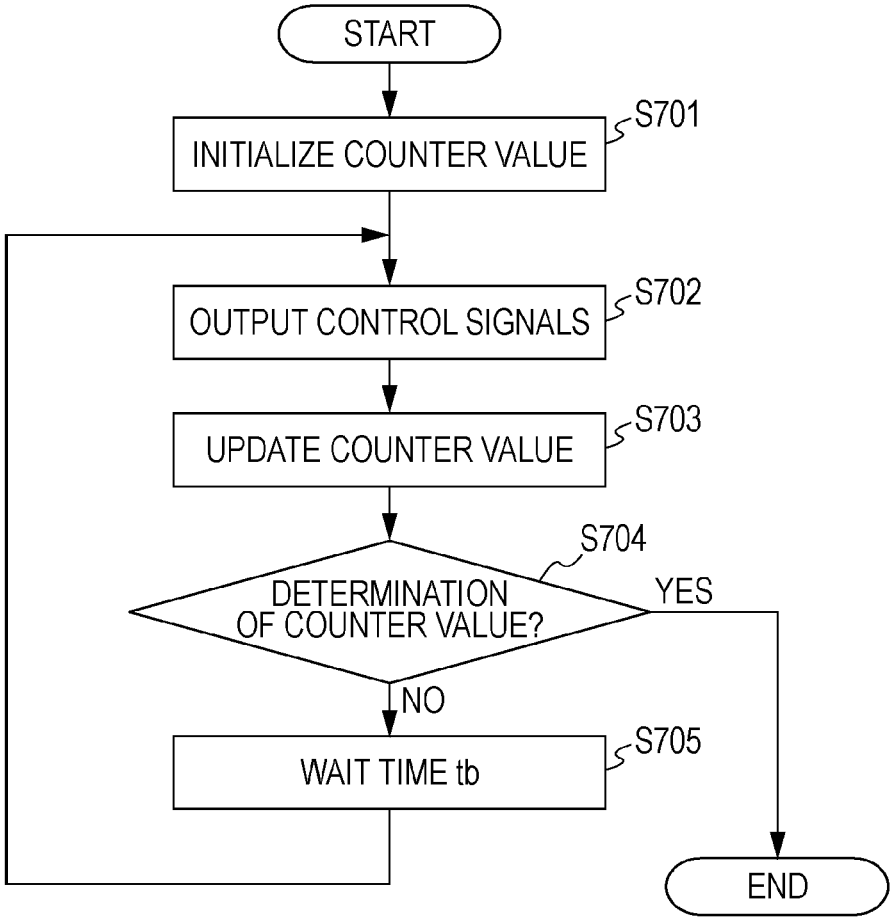
FIG. 7 is a flow of a process of a signal generating section of a test apparatus in the embodiment.

FIG. 7 is a flow of a process of the signal generating section 127 of the test apparatus 801 in the embodiment. In S701, a counter value concerning outputting of a control signal is initialized. For example, because the number of times the heat enable signal (HE) is output is counted to obtain a counter value, the counter value is initialized. Furthermore, a signal for initializing circuits that are provided in the recording head. Next, in S702, signals (control signals including parameters) are output. As illustrated in FIG. 2, the signal generating section 127 sequentially outputs the data signal (D), the latch signal (LT), and the heat enable signal (HE). For example, the data signal D including the instruction (H1) for driving the recording element 107*a* is output.

Then, in S703, the counter value is updated. Whether or not the counter value is a predetermined value is determined. When the counter value is not a predetermined value (ten) (N), the process proceeds to S705. When the counter value becomes the predetermined value (Y), the process finishes.

In S705, the process waits a time tb. This wait is used to set intervals at which the heat enable signal (HE) is output or intervals at which the latch signal (LT) is output to be tb as illustrated in FIG. 2. After that, the process returns to S702, and the signals are output. The data signal D includes the instruction (H2) for driving the recording element 107*b*. Thereafter, the process is performed until the counter value becomes the predetermined value.

Note that, among processes of the signal generating section 127, generation and outputting of signals for the A/D converter 128, the computing section 130, the determination section 131, and so forth are performed. Also regarding the processes, a computation process and a determination process concerning temperature information are sequentially performed, for example, in synchronization with the latch signal (LT).

Accordingly, a step that the test apparatus 801 performs finishes after the computation process and the determination process are performed for all of the eight recording elements.

Note that, when an additional description is made for control timings, the time tb is determined with consideration of timings at which the temperature of ink is acquired. For example, the time tb is determined so that a relationship $tb<tp<2tb$ is satisfied.

Second Embodiment

Next, a second embodiment will be described. Regarding a description of the second embodiment, differences between the first embodiment and the second embodiment will be described.

Figure 4:
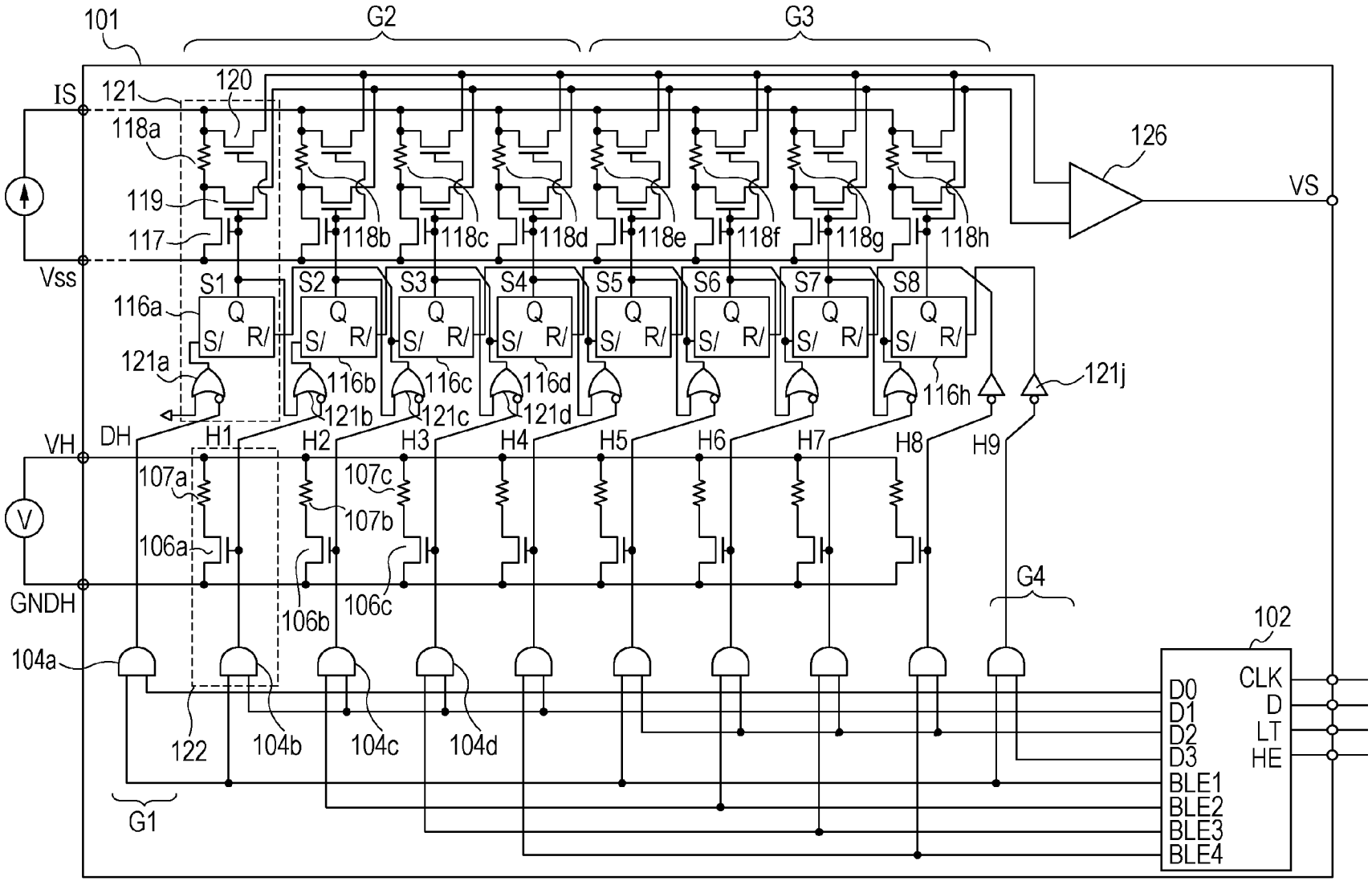
FIG. 4 is a block diagram of a recording-element board in a second embodiment.

FIG. 4 is a diagram for explaining a configuration of a recording-element board 101 in the second embodiment. The circuit configuration is a circuit configuration for acquiring the temperature information, which is described with reference to FIG. 6, concerning temperatures in the time period from the timing t61 to the timing t64.

Each of the number of recording elements and the number of temperature detection elements is eight, and the numbers are the same as those in the first embodiment. However, a signal generating circuit 102 includes four terminals D0 to D3.

The recording-element board 101 further includes ten gate circuits 121*a* to 121*j*. A configuration is provided, in which, using connections of the gate circuits 121*a* to 121*j*, every other signal generating circuit that outputs a signal is selected from among the signal generating circuits 116*a* to 116*h*.

The connections of the gate circuits will be described. For example, an output of the gate circuit 121*c* is connected to the terminal R/ of the signal generating circuit 116*a* and the terminal S/ of the signal generating circuit 116*c*. Furthermore, one of two inputs of the gate circuit 121*c* is connected to an output of the signal generating circuit 116*b*. Similarly, an output of the gate circuit 121*d* is connected to the terminal R/ of the signal generating circuit 116*b* and the terminal S/ of the signal generating circuit 116*d*. One of two inputs of the gate circuit 121*d* is connected to an output of the signal generating circuit 116*c*. By establishing the above-described connections, the signal generating circuits 116*a* to 116*h* are configured so that every other signal generating circuit is selected from among the signal generating circuits 116*a* to 116*h* and the selected signal generating circuits sequentially perform outputting of signals. Hence, every other temperature detection element is selected from among the temperature detection elements 118*a* to 118*h*, and the selected temperature detection elements sequentially perform acquisition of temperatures.

Figure 5A:
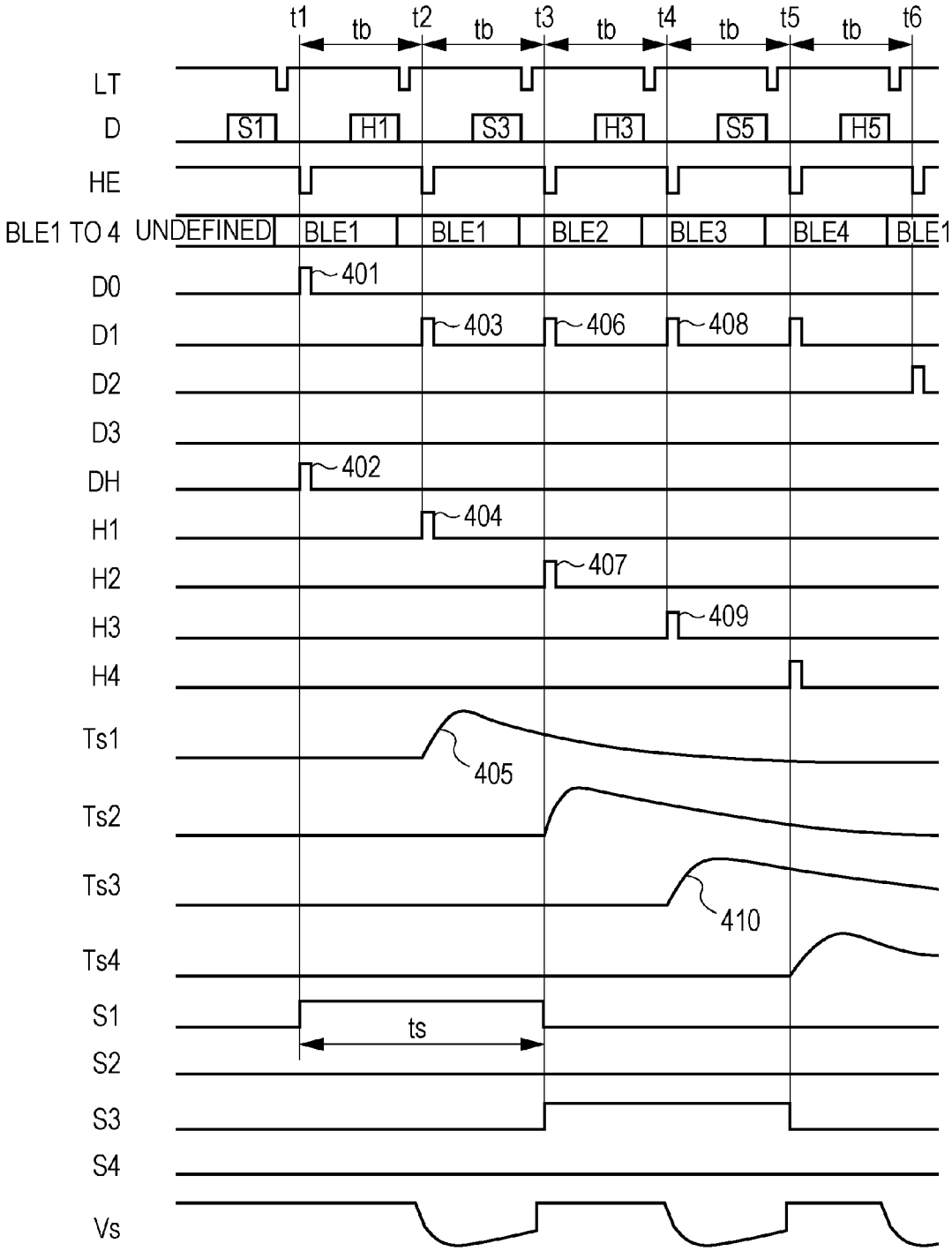
FIG. 5A is a diagram for explaining timings at which control of the recording-element board is performed in the second embodiment.
Figure 5B:
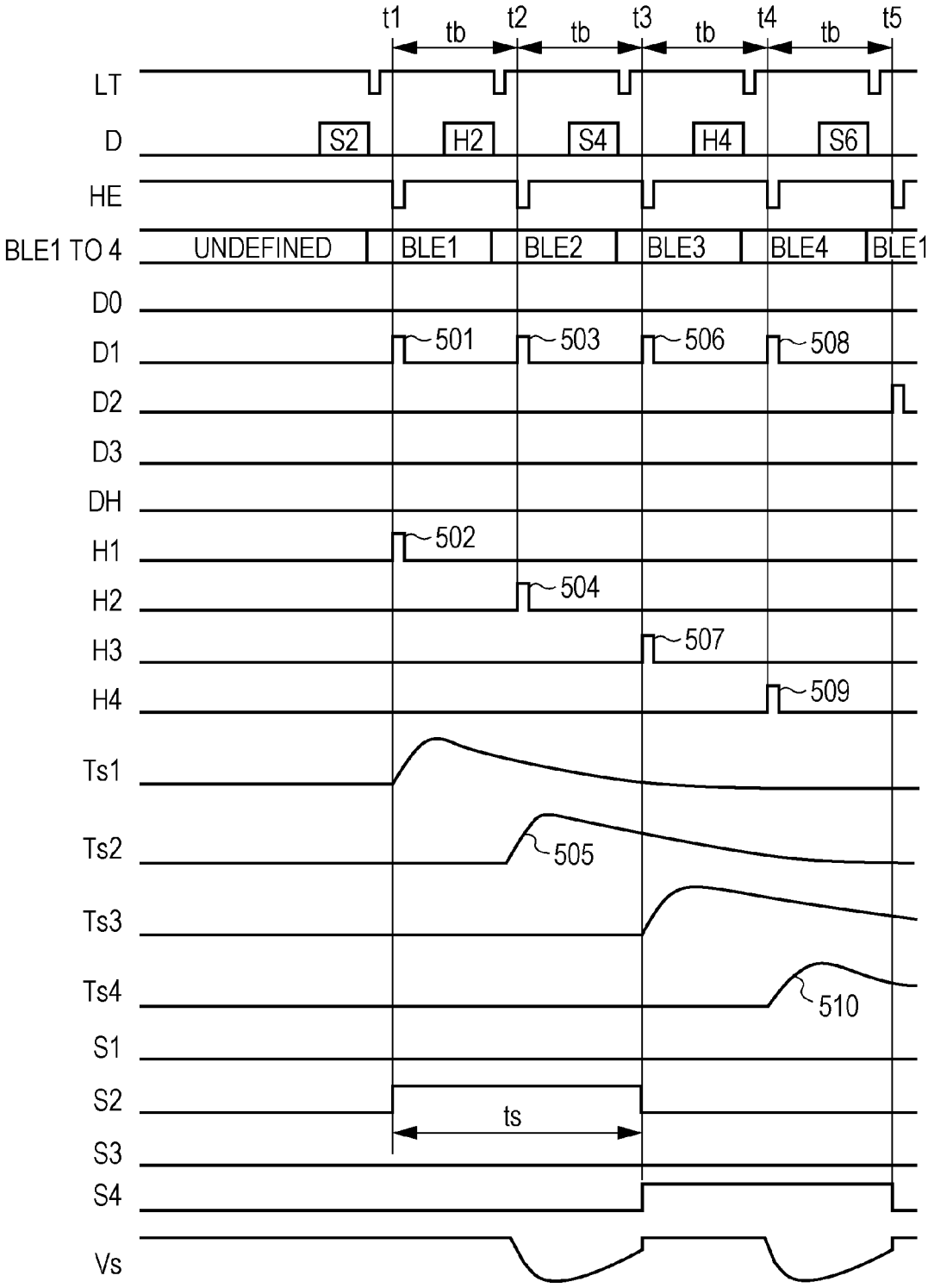
FIG. 5B is a diagram for explaining timings at which control of the recording-element board is performed in the second embodiment.

Next, an operation of FIG. 4 will be described with reference to FIGS. 5(*a*) and 5(*b*). First, a sequence in which the temperature detection elements 118*a*, 118*c*, 118*e*, and 118*g* sequentially acquire temperatures will be described using FIG. 5(*a*).

First, when a data signal D including an instruction (S1) for acquiring temperatures with the temperature detection element 118*a* is input to the signal generating circuit 102, the signal generating circuit 102 enables a signal that is to be output from the terminal BLE1. Then, the signal generating circuit 102 outputs a pulse 401 from the data terminal D0 at a timing t1. The signals are input to the gate circuit 104*a*, and the gate circuit 104*a* outputs a pulse 402 to a signal line DH. Hence, the signal generating circuit 116*a* enables a signal S1 (the signal S1 to be in a high-level state). Hence, outputting of voltages V1 and V2, which correspond to a temperature Ts1, to the differential amplifier 126 is started at the timing t1.

Next, when a data signal D including an instruction (H1) for driving the recording element 107*a* is input to the signal generating circuit 102, the signal generating circuit 102 enables a signal that is to be output from the terminal BLE1. Then, the signal generating circuit 102 outputs a pulse 403 from the data terminal D1 at a timing t2. The signals are input to the gate circuit 104*b*, and the gate circuit 104*b* outputs a purse 404 to a signal line H1. Hence, the switching element 106*a* enters an on-state, and the recording element 107*a* is driven. Heat is generated by the driving, and a temperature Ts1 changes. The temperature detection element 118*a* started detection of temperatures at the timing t1, and performs measurement of a profile 405 until a timing t3.

Next, when a data signal D (S3) including an instruction for stopping acquisition of temperatures with the temperature detection element 118*a* and for starting acquisition of temperatures with the temperature detection element 118*c* is input to the signal generating circuit 102, the signal generating circuit 102 enables a signal that is to be output from the control terminal BLE2. Then, the signal generating circuit 102 outputs a pulse 406 from the data terminal D1 at the timing t3. The signals are input to the gate circuit 104*c*, and the gate circuit 104*c* outputs a pulse 407 to a signal line H2. Hence, the output of the gate circuit 121*c* to which the pulse 407 and the signal S1 are input is input to the terminal R/ of the signal generating circuit 116*a* and the terminal S/ of the signal generating circuit 116*c*. For this reason, the signal generating circuit 116*a* disables an output that is the signal S1 (sets the signal S1 to be in a low-level state), and the signal generating circuit 116*c* enables an output that is the signal S3 (sets the signal S3 to be in a high-level state). Thus, acquisition of temperatures with the temperature detection element 118*a* stops, and acquisition of temperatures with the temperature detection element 118*c* starts.

Next, when a data signal D including an instruction (H3) for driving the recording element 107*c* is input to the signal generating circuit 102, the signal generating circuit 102 enables a signal that is to be output from the terminal BLE3. Then, the signal generating circuit 102 outputs a pulse 408 from the data terminal D1 at a timing t4. The signals are input to the gate circuit 104*d*, and the gate circuit 104*d* outputs a pulse 409 to a signal line H3. Hence, the switching element 106*c* enters an on-state, and the recording element 107*c* is driven. Heat is generated by the driving, and a temperature Ts3 changes. The temperature detection element 118*c* started detection of temperatures at the timing t3, and performs measurement of a profile 410 until a timing t5.

Thereafter, temperatures of the recording elements 107*e* and 107*g* are measured with the temperature detection elements 118*e* and 118*g*, respectively, by performing similar processes.

Note that, because signals that the signal generating circuits 116*b*, 116*d*, 116*f*, and 116*h* output remain disabled in the above-described sequence, acquisition of temperatures with the temperature detection elements 118*b*, 118*d*, 118*f*, and 118*h* is not performed.

Next, a sequence in which the temperature detection elements 118*b*, 118*d*, 118*f*, and 118*h* sequentially acquire temperatures will be described with reference to FIG. 5(*b*). The only difference between this sequence and the sequence that is described with reference to FIG. 5(*a*) is that each of the temperature detection elements which perform acquisition of temperatures is shifted by one.

First, when a data signal D including an instruction (S2) for acquiring temperatures with the temperature detection element 118*b* is input to the signal generating circuit 102, the signal generating circuit 102 outputs a pulse 501 from the data terminal D1 at a timing t1 in a state in which the control terminal BLE1 is enabled.

Next, when a data signal D including an instruction (H2) for driving the recording element 107*b* is input to the signal generating circuit 102, the signal generating circuit 102 outputs a pulse 503 from the data terminal D1 at a timing t2 in a state in which the control terminal BLE2 is enabled.

Next, when a data signal D including an instruction (S4) for acquiring temperatures with the temperature detection element 118*d* is input to the signal generating circuit 102, the signal generating circuit 102 outputs a pulse 506 from the data terminal D1 at a timing t3 in a state in which the control terminal BLE3 is enabled.

Next, when a data signal D including an instruction (H4) for driving the recording element 107*d* is input to the signal generating circuit 102, the signal generating circuit 102 outputs a pulse 508 from the data terminal D1 at a timing t4 in a state in which the control terminal BLE4 is enabled.

With the above-described control of the signal generating circuit 102, acquisition of temperatures including a profile 505 is performed by the temperature detection element 118*b* in a time period from the timing t1 to the timing t3. Acquisition of temperatures including a profile 510 is performed by the temperature detection element 118*d* in a time period from the timing t3 to the timing t5. Thereafter, acquisition of temperatures with the temperature detection element 118*f* and acquisition of temperatures with the temperature detection element 118*h* are sequentially performed.

Note that, when an additional description is made for control timings, a time ts is determined with consideration of timings at which the temperature of ink is acquired. For example, the amount of the ts is determined so that temperatures in a time period from the t61 to the t64 illustrated in FIG. 6 can be detected.

Other Embodiments

The first and second embodiments are described above. However, the present invention is not limited to the above-described numerical values and configurations.

For example, the number of recording elements or temperature detection elements that the recording-element board 101 includes is not limited to eight. A value such as 64, 128, or 256 may be used. Furthermore, the number of signal lines for selecting the recording elements and the number of signal lines for data are not limited to the above-described numbers, and may be determined in accordance with the number of recording elements or the number of time divisions.

Note that the test apparatus which is described in the above-described embodiments is described as an apparatus different from the recording apparatus. However, a configuration may be used, in which the recording apparatus also serves as the test apparatus.

In this case, the signal generating section 127 illustrated in FIG. 6 is configured to have a mode in which signals for recording images are generated in order to serve as the recording apparatus and a mode in which signals for testing are generated in order to serves as the test apparatus.

The invention claimed is:

1. A recording head in which first, second, and third recording elements are arranged in an order, the recording head comprising:

a plurality of driving circuits that generate signals for driving transistors, each of the plurality of driving circuits being provided for a corresponding one of the first, second, and third recording elements;

a plurality of temperature acquisition circuits that acquire temperatures of the first, second, and third recording elements, each of the plurality of temperature acquisition circuits being provided for a corresponding one of the first, second, and third recording elements; and a signal generating circuit that generates signals for sequentially driving the first, second, and third recording elements based on signals that are input from the outside, wherein the temperature acquisition circuit corresponding to the first recording element performs acquisition of a temperature based on a signal that is generated by the driving circuit corresponding to the second recording element and a signal that is generated by the driving circuit corresponding to the third recording element.

2. The recording head according to claim 1, wherein the temperature acquisition circuit corresponding to the first recording element starts acquisition of a temperature based on the signal that is generated by the driving circuit corresponding to the second recording element, and terminates the acquisition of a temperature based on the signal that is generated by the driving circuit corresponding to the third recording element.

3. The recording head according to claim 2, wherein the recording head further comprises a plurality of recording elements and a plurality of driving circuits, each of the plurality of driving circuits being provided for a corresponding one of the plurality of recording elements, and wherein a decoder is connected to each of the plurality of driving circuits, and the connection is established so that a predetermined number of driving circuits are connected to the decoder with a common signal line.

4. The recording head according to claim 1, wherein the recording head further comprises a plurality of recording elements and a plurality of driving circuits, each of the plurality of driving circuits being provided for a corresponding one of the plurality of recording elements, and wherein a decoder is connected to each of the plurality of driving circuits, and the connection is established so that a predetermined number of driving circuits are connected to the decoder with a common signal line.

5. A test apparatus, comprising:

a signal generating section that outputs a signal that is to be input to a decoder for the recording head according to claim 1; and a determination section that determinates a state of the recording head based on temperature information that is acquired by the recording head.

6. A recording head in which first, second, and third recording elements are arranged in an order, the recording head comprising:

first, second, and third driving circuits that generate signals for driving transistors, each of the first, second, and third driving circuits being provided for a corresponding one of the first, second, and third recording elements;

first, second, and third temperature acquisition circuits that acquire temperatures of the first, second, and third recording elements, each of the first, second, and third temperature acquisition circuits being provided for a corresponding one of the first, second, and third recording elements;

a drive-signal generating circuit that generates signals for sequentially driving the first, second, and third recording elements based on signals that are input from the outside; and first, second, and third acquisition-signal generating circuits that generate signals that are to be output to the temperature acquisition circuits, each of the first, second, and third acquisition-signal generating circuits being provided for a corresponding one of the first, second, and third temperature acquisition circuits, wherein the second acquisition-signal generating circuit generates a signal for starting acquisition of a temperature based on a control signal that is output from the first acquisition-signal generating circuit and a signal that is generated by the first driving circuit, and outputs a signal for terminating the acquisition of a temperature based on a control signal that is output from the third acquisition-signal generating circuit and a signal that is generated by the third driving circuit.

7. The recording head according to claim 6, wherein the recording head further comprises a plurality of recording elements and a plurality of driving circuits, each of the plurality of driving circuits being provided for a corresponding one of the plurality of recording elements, and wherein a decoder is connected to each of the plurality of driving circuits, and the connection is established so that a predetermined number of driving circuits are connected to the decoder with a common signal line.

* * * * *